US008113974B1

(12) United States Patent
Ward, Jr.

(10) Patent No.: US 8,113,974 B1
(45) **Date of Patent: *Feb. 14, 2012**

(54) HUNTING ARROW POINT

(75) Inventor: Michael Kenneth Ward, Jr., Great Bend, KS (US)

(73) Assignee: Magnus, Inc., Great Bend, KS (US)

( * ) Notice: Subject to any disclaimer, the term of this patent is extended or adjusted under 35 U.S.C. 154(b) by 402 days.

This patent is subject to a terminal disclaimer.

(21) Appl. No.: 12/359,666

(22) Filed: Jan. 26, 2009

(51) Int. Cl.
*F42B 6/08* (2006.01)

(52) U.S. Cl. ..... 473/584; 473/583

(58) Field of Classification Search ..... 473/583, 473/584

See application file for complete search history.

(56) References Cited

U.S. PATENT DOCUMENTS 2,289,284 A * 7/1942 Chandler ..... 473/584
5,931,751 A * 8/1999 Cooper ..... 473/583
7,182,706 B2 * 2/2007 Barrie ..... 473/584
7,393,295 B1 7/2008 Futtere
2008/0234079 A1 * 9/2008 Butcher ..... 473/584
2008/0261734 A1 * 10/2008 Cooper ..... 473/584

* cited by examiner

*Primary Examiner* — John Ricci
(74) *Attorney, Agent, or Firm* — Kenneth H. Jack; Davis & Jack, L.L.C.

(57) ABSTRACT

A hunting arrow point having a ferrule having a forward nose, a rearward shank, and a body, the body having a plurality of radially outwardly opening apertures; the point further having blades, each blade having a proximal end, a distal end, a forward end, and a rearward end, each proximal end having an eye, each blade's forward end having a sharpened edge, each blade being positioned so that its eye aligns over one of the ferrule's apertures; the point receiving screws, each screw extending through one of the blade's eyes and engaging one of the ferrule's apertures; and the point presenting a plurality of pivot stops, each pivot stop being fixedly attached to or formed wholly with the ferrule, each pivot stop being positioned for biasing against one of the blades upon application of a rearwardly directed force to the blade, and each blade being forwardly canted.

6 Claims, 6 Drawing Sheets

HUNTING ARROW POINT

FIELD OF THE INVENTION

This invention relates to archery and hunting and arrow points. More particularly, this invention relates to arrow points adapted for killing turkey and other game birds.

BACKGROUND OF THE INVENTION

Where bow hunters engage in hunting of birds such as turkeys, a light duty bow is often selected and utilized by the hunter, such bow typically throwing a light arrow shaft. In keeping with the desirable light weight of game bird bow hunting equipment, the points attached to arrow shafts used in such hunting are similarly light weight.

A problem associated with bow hunting of game birds arises from the fact that the bodies of game birds typically present small killing zones to be targeted by an archer. For example, the preferred killing zone at a turkey's head often is as small as 2" in diameter. In order to compensate for the small targetable killing zones presented by game birds, game fowl arrow points are known to include a radially extending array of cantilevered blades. Such arrangement of blades advantageously increases the effective target size of the arrow point with respect to a particular game bird. For example, where a turkey head presents a 2" diameter target and where the blades of the game bird arrow point extend 2" radially outwardly from the arrow's longitudinal axis, the effective target size is increased to approximately 4" in diameter.

The above described need for game bird arrow points to be light in weight and the above described need for such arrow points to increase the effective target size, give rise to further problems and deficiencies. Light weight cantilevering arrow point blades are easily damaged and, upon damage, are desirably replaced. Known assemblies for facilitating interchangeable attachment and replacement of such blades often insecurely attach the blades, allowing the blades to fall off and be lost. Such assemblies also often require mechanically complex or difficult assembly and disassembly steps.

Another problem associated with such known cantilevering blade game bird killing arrow points relates to the an arrow spinning function of an arrow's fletching. The fletching or vanes, which are typically attached to an arrow's shaft immediately forward of the arrow's knock, are commonly arranged in a slightly helically twisting pattern. Helically twisting fletching installations advantageously spin the arrow about its longitudinal axis during flight, helping the arrow stay true to an aimed trajectory. Such known cantilevering blade game bird killing arrow points undesirably introduce air drag which opposes or interrupts the arrow's desired spin about its longitudinal axis. Such drag against axial spin tends to destabilize the arrow during flight.

The instant inventive game bird killing arrow point solves or ameliorates problems and deficiencies discussed above by configuring the point to include a unique and useful combination of screw and eye fasteners, ferrule mounting structures, blade mounting structures, and pivot stops.

BRIEF SUMMARY OF THE INVENTION

A first structural component of the instant inventive game bird killing arrow point comprises a ferrule having a forward nose, a rearward shank, and a body portion situated between the forward nose and the rearward shank. The nose, body, and shank portions are preferably formed wholly together in a milling or molding fabrication process. Preferably, the body portion of the ferrule is configured to include or present a plurality of radially outwardly opening helically threaded screw receiving apertures.

Further components of the instant inventive arrow point preferably comprise a plurality of thin light weight blades, each blade having a proximal end, a distal end, a forwardly oriented and sharpened flesh cutting end, and a rearward end. Each blade's proximal end or haft is preferably configured to present a screw receiving eye which extends therethrough in the radial direction. In a preferred embodiment of the instant invention, each of the blades, upon attachment to the ferrule component, is positioned with respect to the ferrule so that the eye at the blade's proximal end overlies and aligns with one of the ferrule's radially outwardly opening helically threaded apertures. A plurality of helically threaded screws are provided, such screws being utilized to removably and interchangeably attach the blades to the ferrule at the sites of the helically threaded apertures.

A further structural component of the instant inventive small game killing arrow point comprises a plurality of pivot stops, each pivot stop being fixedly attached to or formed wholly with the ferrule. The pivot stops are preferably operatively positioned upon the ferrule so that, upon screw attachments of the blades to the ferrule, and upon cutting impingement of the sharpened edge of one of the blades against a game animal, the applicable pivot stops will impinge against and apply counter-torque to said one blade, stopping pivoting movement of such blade about the screw in the rearward direction.

A further component of the instant inventive hunting arrow point comprises blade rotating pitch means connected to or formed wholly as a part of the ferrule. Where the blades are installed upon the ferrule so that they are canted at an angle of 0° with respect to the ferrule's longitudinal axis, such blades undesirably tend to act as air brakes, resisting rotation of the arrow about its longitudinal axis. Such rotation is desirably impelled by a slightly helical installation of an arrow's fletchings, and it is desirable that other structures associated with the arrow (such as the cantilevering blades of the instant invention) not interfere with such rotation. Accordingly, the blade pitch means angularly cants the blades so that they function as ferrule and arrow shaft turning vanes, complimenting rather than hindering the desirable rotation impelled by the fletchings. In a preferred embodiment of the instant invention, the blade pitch means comprises either a forward or a rearward (and preferably forward) angular tilt, or cant of blade mounting lands about the body of the ferrule. Other means for creating a blade rotating pitch, such as providing a step within blade receiving channels, are considered to fall within the scope of the invention.

In order to facilitate secure mounts of the blades upon the ferrule, the body portion of the ferrule preferably is milled or molded to present a plurality of substantially flat or stepped blade mounting lands, such lands preferably being forwardly angularly canted or stepped as described above. Where such mounting lands are provided, each of the ferrule's radially outwardly opening helically threaded apertures is preferably further positioned so that it opens at the site of one of the lands.

Also in the preferred embodiment of the instant inventive small game killing arrow point, each pivot stop comprises at least a first wall that either faces forwardly from the rear of the blade or faces rearwardly from a front surface of the blade. Preferably, such rearwardly or forwardly facing walls are paired and are oppositely oriented so that they, in combination with the flat or stepped mounting lands, form fitted blade haft receiving channels. In the preferred embodiment, and where such blade haft receiving pivot stopping channels are provided, the ferrule is milled or molded so that the depths of such channels are approximately equal to the radial thicknesses of the proximal ends or hafts of the blades. Such fitting of channel depths to blade thicknesses advantageously minimizes both the weight of the point and wind resistance or drag experienced by the point.

In the preferred embodiment of the instant inventive game bird killing arrow point, the ferrule's radially outwardly opening helically threaded screw receiving apertures and the blades are arranged in a radially symmetric fashion. Where three blades are provided, a triangular radial symmetry is preferred. Where four blades are provided, a quadrilateral radial symmetry is preferred. Where five blades are provided, a pentagonal radial symmetry is preferred, and where six blades are provided, a hexagonal radial symmetry is preferred. The scope of the instant invention is not considered to be restricted to any particular number of blades. However, a three bladed and triangularly radially symmetric point, as is drawn in the appended drawings, is preferred.

Also in the preferred embodiment of the instant invention, the forward nose of the ferrule is conical and is pointed, and the rearward shank is preferably helically threaded for convenient "screw-on/screw-off" arrow shaft mounting. In order to further reduce the weight of the inventive arrow point, a series of voids may be milled or molded into the forward nose portion of the ferrule or may be milled or molded axially into the rearward shank of the ferrule. Preferably, the ferrule comprises aluminum, and the blade and blade mounting screws comprise tempered steel. Suitably, the ferrule component may alternatively comprises titanium.

In use of the instant inventive game bird killing arrow point, a bow hunter may initially be supplied with a series of blades configured as described above, along with a supply of blade attachment screws. Suitably, the blades from which the bow hunter selects may be of varying lengths. Where the ferrule includes the preferred triangular radial symmetry, the bow hunter may select three blades of identical length and may utilize three attachment screws for attachment of such three blades to the ferrule. Where the ferrule presents the preferred pivot stopping blade haft receiving channels, as described above, the hafts or proximal ends of the blades may be placed within such channels so that their cutting edges are oriented forwardly, and so that the radially extending eyes of such blades align with and overlie the ferrule's screw receiving apertures. Upon such alignments, the attachment screws may be threadedly installed and tightened.

During the flight of an arrow armed with the inventive game bird killing arrow point toward, for example, the head of turkey, the blade rotating pitch means advantageously compliments the arrow shaft rotation provided by the arrow's fletching, upon reaching the turkey, one of the cantilevered blades may forcefully impinge against the head of the turkey, such contact tending to pivot the blade rearwardly. Upon such contact, the pivot stopping wall of the channel into which said one blade is installed advantageously applies counter-torque to the blade, stopping such rearward pivoting motion and causing the blade to drive through the turkey's head, killing the turkey.

In the event that one or more of such installed blades are damaged as the result of being so launched, the blade attachment screws are easily withdrawn and replacement blades are easily substituted and re-installed.

Accordingly, objects of the instant invention include the provision of a game bird killing arrow point that incorporates structures and features as described above, such structures and features are functionally arranged as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
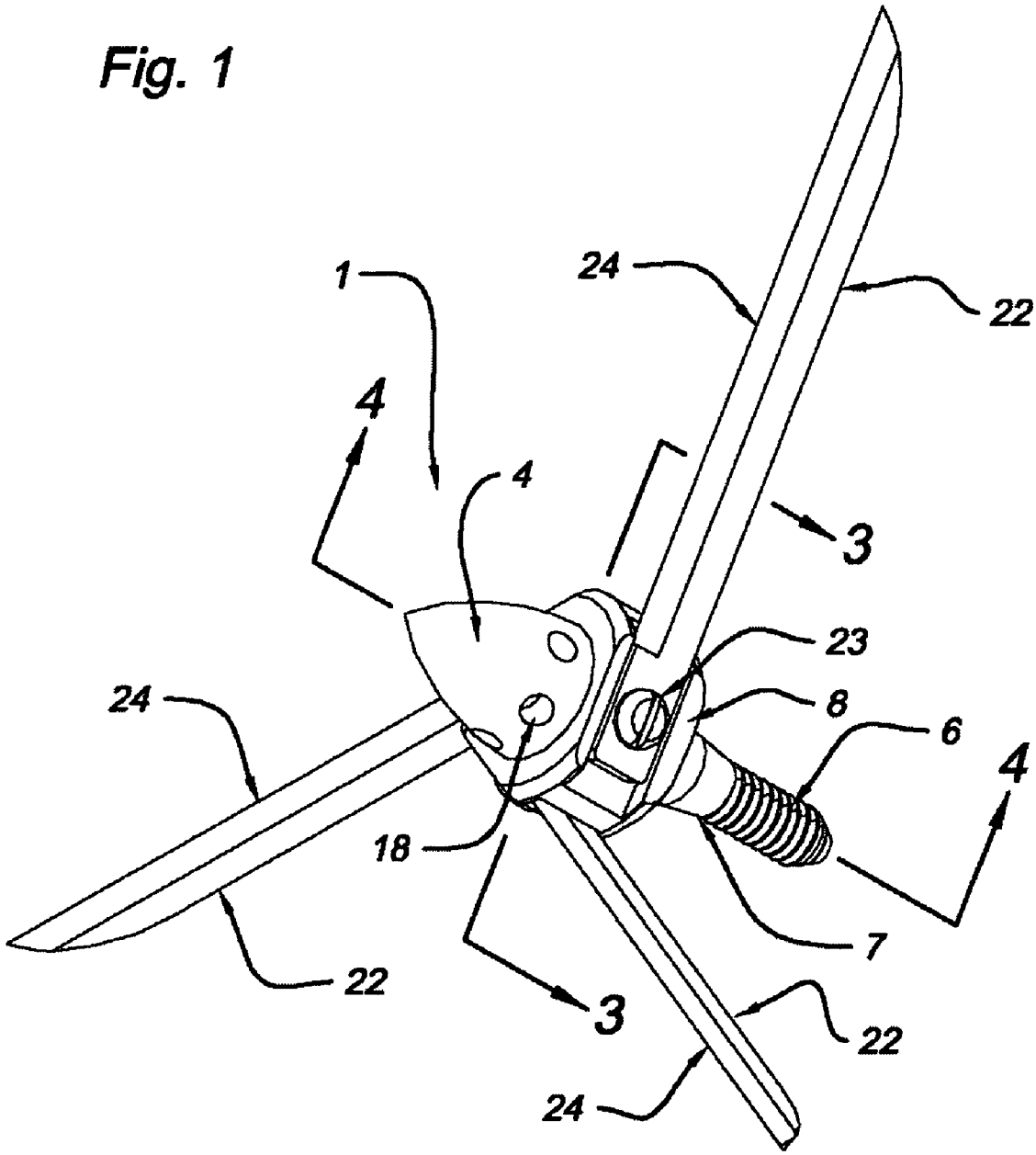
FIG. 1 is a isometric view of a preferred embodiment of the instant inventive game bird killing arrow point.
Figure 2:
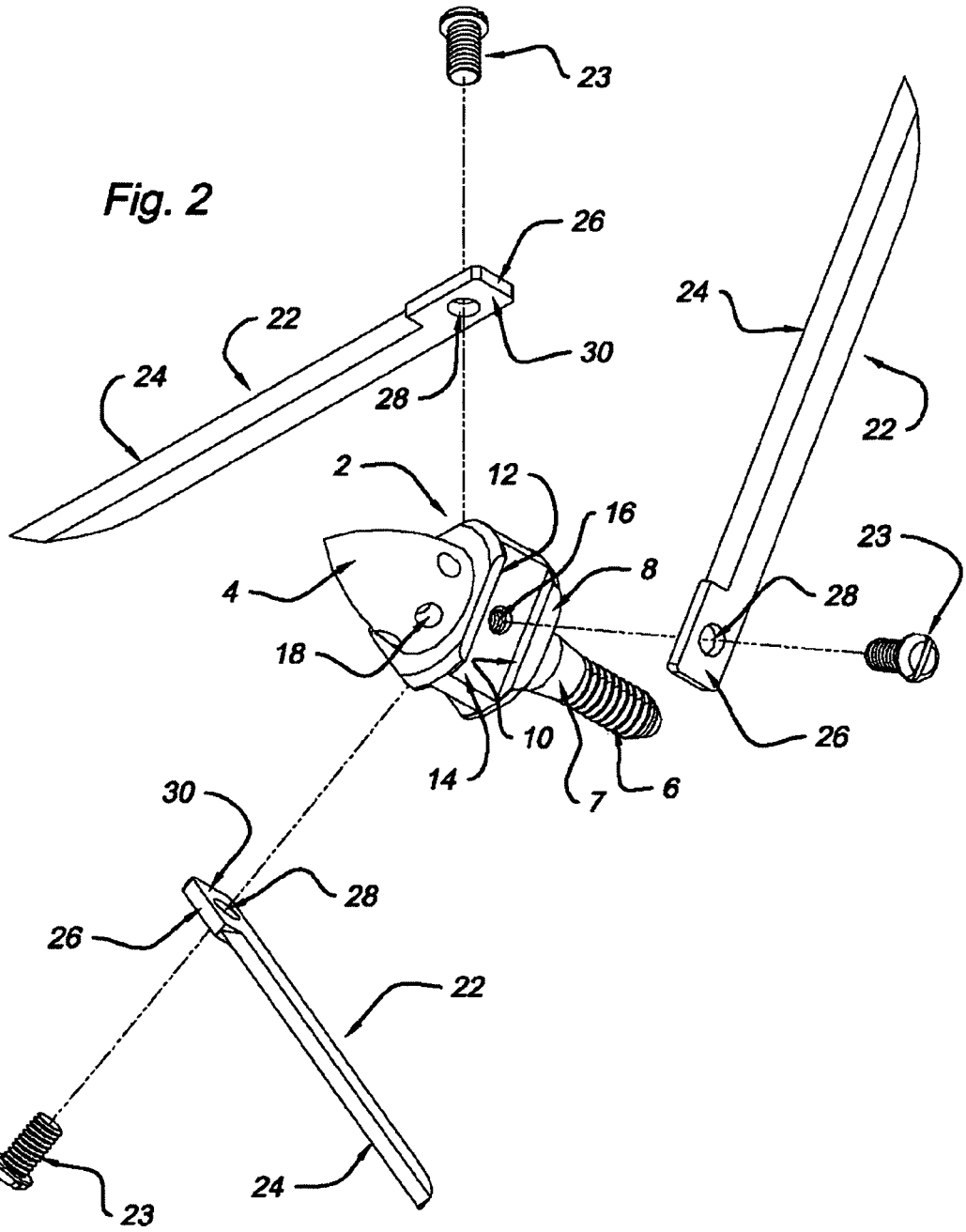
FIG. 2 is an exploded view of the arrow point of FIG. 1.

Referring now to the drawings, and in particular to FIG. 1, a preferred embodiment of the instant inventive game bird killing arrow point is referred to generally by Reference Arrow 1. A major structural component of the arrow point 1 comprises a ferrule that, referring further simultaneously to FIG. 2, is identified generally by Reference Arrow 2. The ferrule 2 preferably comprises a rearward extending shank 7, a forward nose 4, and an intermediate or medially positioned body portion 8.

Referring further simultaneously to FIGS. 1 and 2, the body portion 8 of the ferrule 2 is preferably molded or milled to include both a forwardly facing slide stopping wall 10 and a rearwardly facing slide stopping wall 12, said slide stopping walls 10 and 12 advantageously forming and defining a blade receiving and pivot stopping channel. The floor of such channel is advantageously configured as a substantially flat blade mounting land 14. Preferably, a radially outwardly opening helically threaded screw receiving aperture 16 is positioned within and opens at the flat blade mounting land 14.

Figure 3:
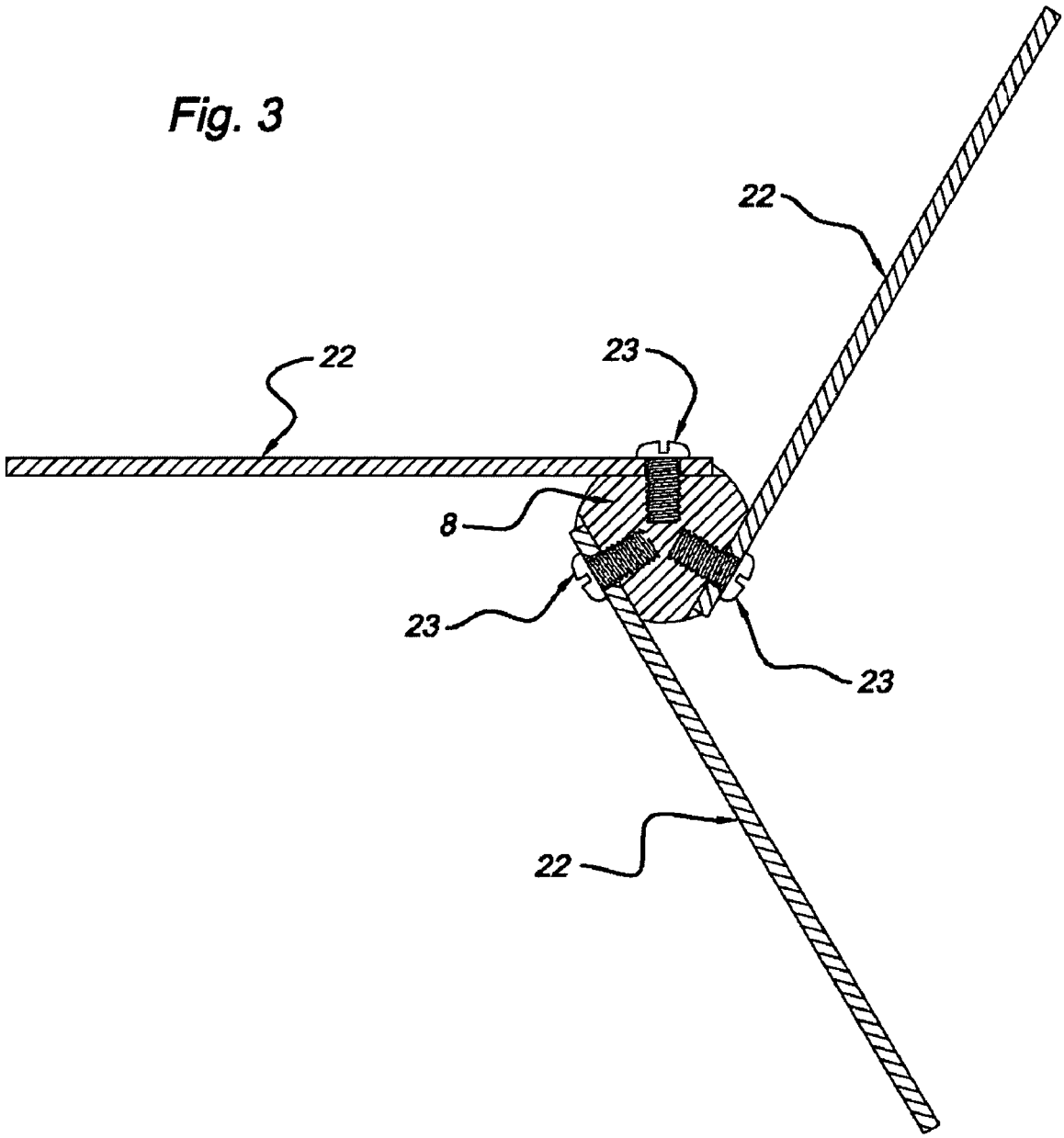
FIG. 3 is a sectional view as indicated in FIG. 1.
Figure 4:
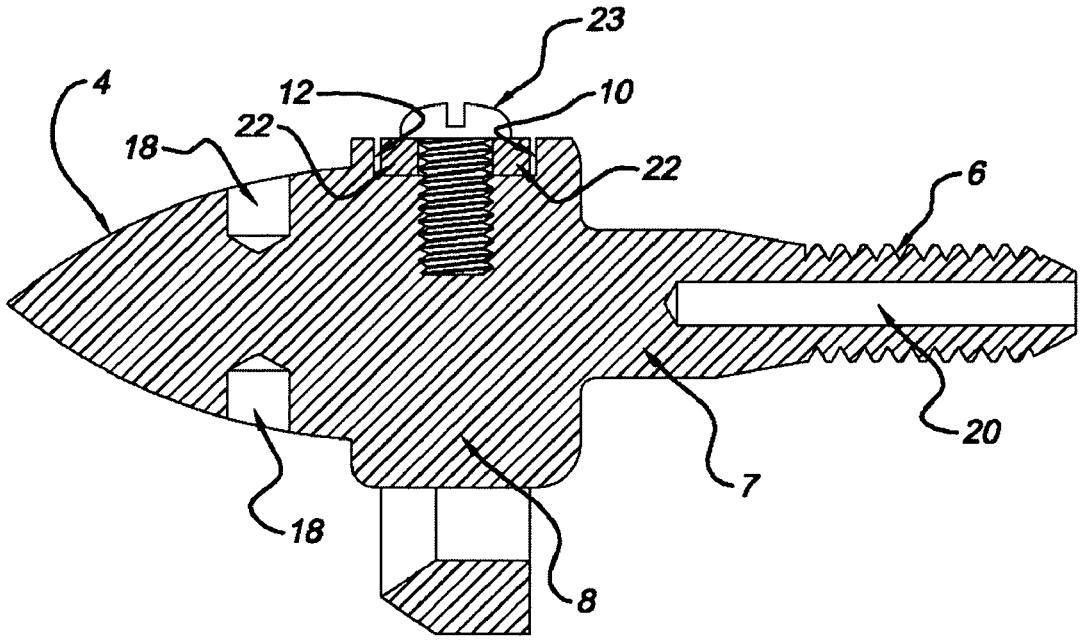
FIG. 4 is an alternative sectional view as indicated in FIG. 1.

Referring simultaneously to FIGS. 1-3, it can be seen that the body portion 8 of the ferrule 2 is further molded or milled to present a triangular radial symmetry, such symmetry being representative of other possible symmetries, such as square, pentagonal, or hexagonal. In the triangular radial symmetry configuration depicted in FIGS. 1 and 3, each of the three radial sides of the body portion 8 of the ferrule 2 is substantially identically configured to include forwardly facing and rearwardly facing walls 10 and 12, a channel floor/attachment land 14 and a helically threaded screw receiving aperture 16. Referring further simultaneously to FIG. 4, weight saving voids 18 and 20 may be molded into or milled into a nose 4 or the shank 7 of the ferrule 2. Preferably, the shank 7 includes helical threads for convenient interchangeable attachment to an arrow shaft (not depicted).

Referring to FIG. 2, a plurality of blades are identified generally by Reference Arrows 22. Each blade 22 is preferably configured substantially identically with each other blade 22. In the preferred embodiment, the blades 22 are representative of variably dimensioned triples of blades that may be selected by the bow hunter for use in various small game hunting applications. Each blade 22 has a proximal or haft end 26, each proximal or haft end 26 having a preferably substantially flat radially inner surface 40. Also, each proximal or haft end 26 has a screw receiving eye 28 extending radially therethrough. As is depicted in FIG. 2, each screw receiving eye preferably has an annular wall and is circular. However, the scope of the invention is considered to include differently configured eyes such as oblong apertures, square or rectangular apertures, or apertures in the nature of a slot that further opens at a blade edge. Each blade 22 preferably further has a sharpened forwardly oriented cutting edge 24. Helically threaded screws 23 are preferably provided, such screws being fitted for inward extension through the eyes 28 of the blades 22, and for helically threaded engagement with the helical threaded apertures 16 within the body portion 8 of the ferrule 2.

FIG. 1 represents an assembled configuration of the instant inventive game bird killing arrow point, and FIG. 2 represents its disassembled configuration. In assembling the arrow point, a bow hunter may initially place the proximal or haft end 26 of one of the blades 22 within one of the channels defined by paired pivoting stopping walls 10 and 12 and mounting land 14. Upon so inserting such proximal blade end, the bow hunter may align the blade's eye 28 over helically threaded aperture 16. Thereafter, the bow hunter may manually inwardly insert screw 23 through eye 28 to initially enter helically threaded aperture 16. Thereafter, the bow hunter may utilize a common screwdriver to further engage the screw 23 with the helically threaded aperture 16, tightening the head of screw 23 against the proximal or haft end of the blade 22 as is depicted in FIGS. 3 and 4. Thereafter, such bow hunter may repeat such blade installation steps in sequence upon the other two blades 22 depicted in FIG. 2, completing the assembly depicted in FIG. 1.

Figure 5:
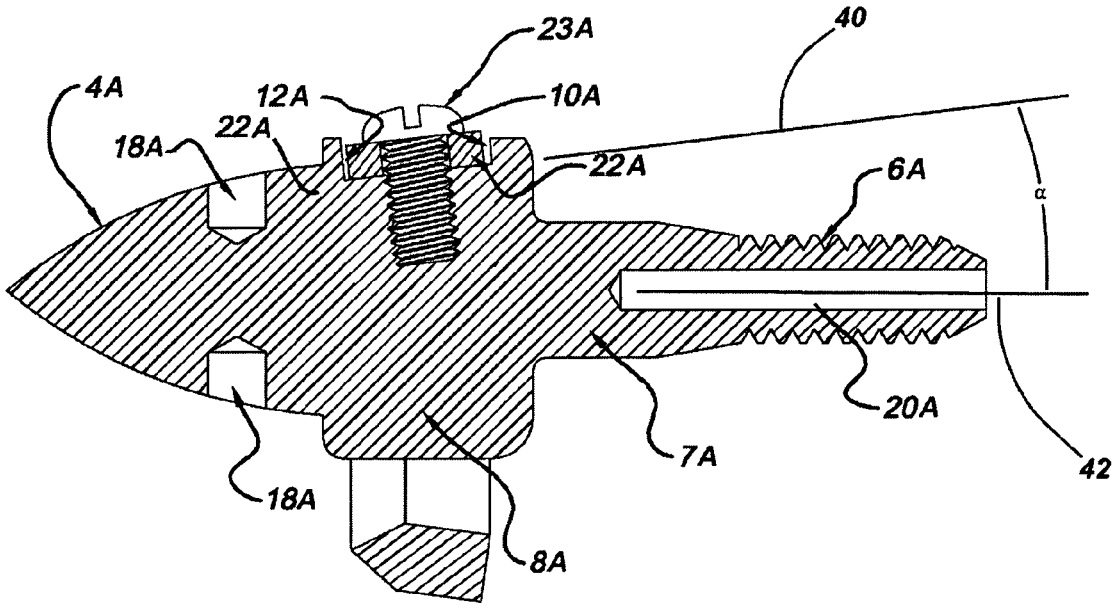
FIG. 5 re-depicts FIG. 4, the view of FIG. 5 showing blade pitch means, such means canting the blades angularly with respect to the point's longitudinal axis.
Figure 6:
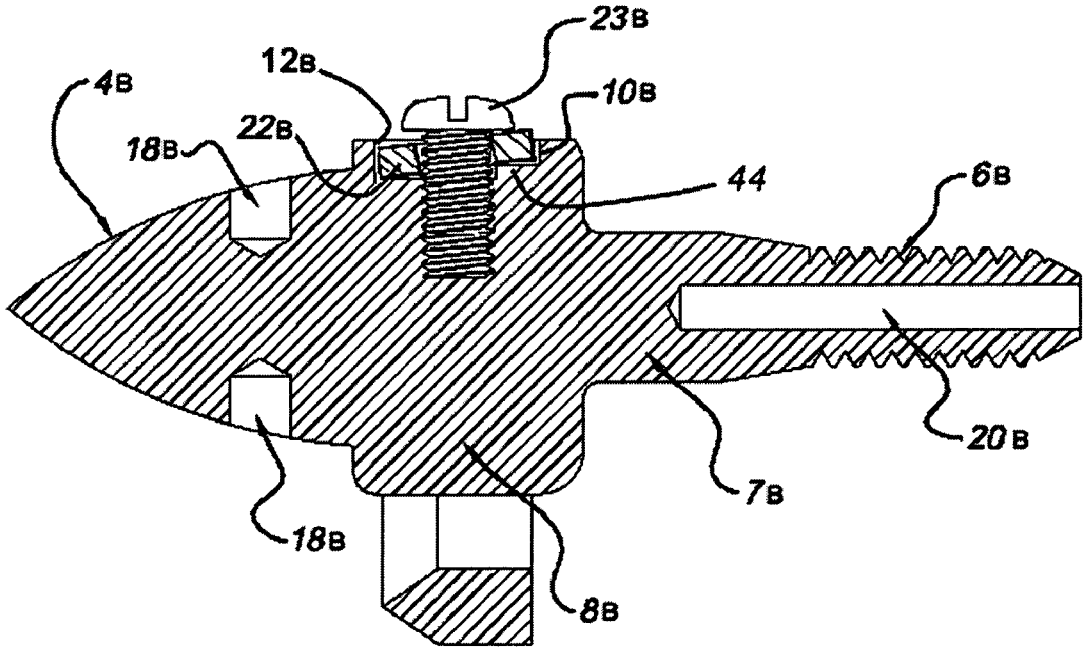
FIG. 6 redepicts FIG. 5, the view of FIG. 6 alternatively shows a stepped land as blade canting means.

Referring to FIGS. 5 and 6, structures identified by reference numerals having the suffix "A" and "B" are substantially identical to similarly numbered structures appearing in FIGS. 1-4. FIG. 5 alternatively shows the substantially flat blade mounting lands 14 (see FIG. 2) angularly canted forwardly an angle $\alpha$ with respect to the point's longitudinal axis 42. Alternatively, as shown in FIG. 6, step 44 provides such cant and angle $\alpha$. Such angle $\alpha$ is preferably positive, tilting the angled or stepped lands forwardly, such angle preferably having a magnitude between 2° and 8°. The depicted angular canting or stepping of the lands and the blades 22A or 22B mounted thereon constitutes preferred blade pitch means which are intended to compliment the typical helical installation of an arrow's fletchings.

Upon achieving the assembly depicted in FIG. 1 (or FIG. 5 or 6, as the case may be), the bow hunter may install the arrow point 1 upon the forward end of an arrow shaft (not depicted) utilizing the helical threads 6 of the shank 7 of the ferrule 2. Thereafter, the inventive arrow point 1 is suitably configured for targeting upon and launching toward a game bird, such as a turkey.

During flight, the blade pitch means depicted in FIGS. 5 and 6 may advantageously compliment the arrow spinning effect of the arrow's fletchings.

Referring to FIG. 1, upon impingement at high velocity of the cutting edge 24 of one of the blades 22 of the arrow point 1 against, for example, the head of a turkey, such blade may cut and drive through the head, killing the turkey in a quick and humane fashion. As the blade 22 drives against the turkey's head, impact forces tend to drive and pivot the blade 22 rearwardly about screw 23. Such pivoting motion is, referring further simultaneously to FIG. 2, advantageously stopped by counter-torque imposed by pivot stopping walls 10 and 12. Preferably, the height of the pivot stopping walls 10 and 12 is closely fitted to the radial thickness of the proximal or haft ends 26 of the blades 22, such fitting minimizing both weight and wind resistance.

Referring further to FIG. 1, upon any launching of the game bird killing arrow point 1, one or more of the blades 22 may strike a hard surface, such as a rock or tree root, undesirably bending or breaking the blade 22. Upon the occurrence of such blade damage, a bow hunter may easily utilize a screwdriver to extract the applicable screw 23 and may easily and conveniently replace the damaged blade with a new undamaged blade that exactly matches the remaining undamaged blades.

In the preferred embodiment of the instant invention, the ferrule portion 2 of the small game killing arrow point 1 comprises aluminum and the blades 22 and screws 23 preferably comprise tempered steel.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A hunting arrow point comprising:

(a) a ferrule having a forward nose, a rearward shank, and a body between the forward nose and the rearward shank, the body having a plurality of radially outwardly opening helically threaded apertures;

(b) a plurality of blades, each blade having a proximal end, a distal end, a forward end, and a rearward end, each blade's proximal end having an eye extending radially therethrough, each blade's forward end having a sharpened edge, each blade being positioned with respect to the ferrule so that its eye aligns over one of the ferrule's radially outwardly opening helically threaded apertures;

(c) a plurality of screws, each screw extending through one of the blade's eyes and threadedly engaging one of the ferrule's radially outwardly opening helically threaded apertures; and (d) a plurality of pivot stops fixedly attached to or formed wholly with the ferrule, each pivot stop being positioned for biasing against one of the blades upon application of a rearwardly directed force to the one of the blades; and (e) blade pitch means connected to or formed wholly with the ferrule; the ferrule's body presenting a plurality of substantially flat blade mounting lands, each of the ferrule's radially outwardly opening helically threaded apertures opening at one of the ferrule's substantially flat blade mounting lands, the blade pitch means comprising angular canting of the substantially flat blade mounting lands.

2. The hunting arrow point of claim 1 wherein the ferrule has a longitudinal axis, and wherein the substantial flat blade mounting lands' angular cants are between 2° and 8° with respect to the longitudinal axis.

3. The hunting arrow point of claim 2 wherein each of the substantially flat blade mounting lands' angular cants are forwardly tilted.

4. A hunting arrow point comprising:

(a) a ferrule having a forward nose, a rearward shank, and a body between the forward nose and the rearward shank, the body having a plurality of radially outwardly opening helically threaded apertures;

(b) a plurality of blades, each blade having a proximal end, a distal end, a forward end, and a rearward end, each blade's proximal end having an eye extending radially therethrough, each blade's forward end having a sharpened edge, each blade being positioned with respect to the ferrule so that its eye aligns over one of the ferrule's radially outwardly opening helically threaded apertures;

(c) a plurality of screws, each screw extending through one of the blade's eyes and threadedly engaging one of the ferrule's radially outwardly opening helically threaded apertures; and (d) a plurality of pivot stops fixedly attached to or formed wholly with the ferrule, each pivot stop being positioned for biasing against one of the blades upon application of a rearwardly directed force to the one of the blades; and (e) blade pitch means connected to or formed wholly with the ferrule; the ferrule's body presenting a plurality of stepped blade mounting lands, each of the ferrule's radially outwardly opening helically threaded apertures opening at one of the ferrules' stepped blade mounting lands, the blade pitch means comprising the stepping of said lands.

5. The hunting arrow point of claim 4 wherein the ferrule has a longitudinal axis, and wherein the stepped blade mounting lands' are configured to cant the blades between 2° and 8° with respect to the longitudinal axis.

6. The hunting arrow point of claim 5 wherein each of the stepped blade mounting lands forwardly tilt one of the blades.

* * * * *